US005236008A

United States Patent [19]

Bennitt

[11] Patent Number: 5,236,008

[45] Date of Patent: Aug. 17, 1993

[54] SEALING RING CARRIER AND VALVE SUPPORT

[75] Inventor: Robert A. Bennitt, Painted Post, N.Y.

[73] Assignee: Dresser-Rand Company, Corning, N.Y.

[21] Appl. No.: 899,806

[22] Filed: Jun. 17, 1992

[51] Int. Cl.[5] ..... F04B 21/08

[52] U.S. Cl. ..... 137/512; 417/526

[58] Field of Search ..... 137/512; 417/523-527

[56] References Cited

U.S. PATENT DOCUMENTS

| | | | |
|---|---|---|---|
| 314,117 | 3/1885 | Foster | 417/526 |
| 921,890 | 5/1909 | Rider | 417/525 |
| 1,628,340 | 5/1927 | Thompson | 417/524 |
| 1,632,436 | 6/1927 | Dinesen | 417/525 |
| 2,245,227 | 6/1941 | Rossmann | 417/525 X |

*Primary Examiner*—Robert G. Nilson

*Attorney, Agent, or Firm*—Bernard J. Murphy

[57] ABSTRACT

A body having a longitudinal axis, and parallel bearing surfaces at opposite axial ends thereof, has grooves formed therein, adjacent both axial ends thereof for receiving sealing rings therein. The body is interposed between fluid-control valves which are centrally supported, in spaced-apart disposition on a reciprocable rod, for abutting engagement thereof with the outermost peripheries of axial ends of the valves to support the valves and prevent bending moments from being exerted on the valves, and the grooves-receivable sealing rings offer enhanced fluid sealing over that carried by the valves themselves.

7 Claims, 1 Drawing Sheet

SEALING RING CARRIER AND VALVE SUPPORT

This invention pertains to one-way fluid valves which carry sealing rings thereabout and are reciprocable within a cylinder, (a) to compress fluid within the cylinder, and (b) to admit the compressed fluid therethrough, and in particular to a sealing ring carrier and valve support for such valves, for providing additional fluid sealing and outer or peripheral valve support.

In U.S. Pat. No. 5,015,158, issued to Robert A. Bennitt, on May 14, 1991, for a Gas Compressor, there is disclosed a compressor formed of a straight cylinder having inlet valves set in axial ends thereof and discharge valves carried on a reciprocable piston rod which translates within the cylinder. For given cylinder bore and valve diameters and discharge pressures, sealing rings carried by the aforesaid discharge valves are adequate. However, if the compressor design is to contemplate a greater operational envelope, greater pressure, larger diameter bores and valves, there arises a need to increase the quantity of sealing rings, and support of the valves about the outermost peripheries of axial ends thereof. With a center-supported valve, i.e., centrally supported by the aforesaid piston rod, the bending moment exerted on the valve is directly related to both the pressure and the diameter of the bore and valve.

It is an object of this invention to set forth a sealing ring carrier and valve support which meets the cited need.

It is particularly an object of this invention to set forth, in combination with fluid-control valves, centrally supported, in spaced-apart disposition on a reciprocable rod, a sealing ring carrier and valve support, comprising a body having a longitudinal axis, and parallel bearing surfaces at opposite ends thereof; wherein said body is interposed between said valves; and said bearing surfaces are in abutting engagement with outermost peripheries of axial ends of said valves.

It is also an object of this invention to disclose a sealing ring carrier and valve support, comprising a body having (a) a longitudinal axis, and (b) parallel bearing surfaces at opposite axial ends thereof; wherein said body has means formed therein, adjacent both axial ends thereof, for receiving body-circumscribing sealing elements.

Further objects of this invention, as well as the novel features thereof, will be apparent from the following description taken in conjunction with the accompanying figures, in which.

The aforecited U.S. Pat. No. 5,015,158 is incorporated by reference, as the same offers a thorough disclosure of one-way valves, piston-ringed, and carried in spaced-apart disposition, centrally on a reciprocable rod, in a straight cylinder. Also, U.S. Pat. No. 5,011,383, also issued to Robert A. Bennitt, on Apr. 30, 1991, for a Valve Assembly, for Use in Combination with a Straight-Cylinder, Gas-Compression Chamber, and in Combination Therewith, is hereby incorporated by reference, for a disclosure of the one-way valves of the type contemplated by the instant invention.

Figure 1:
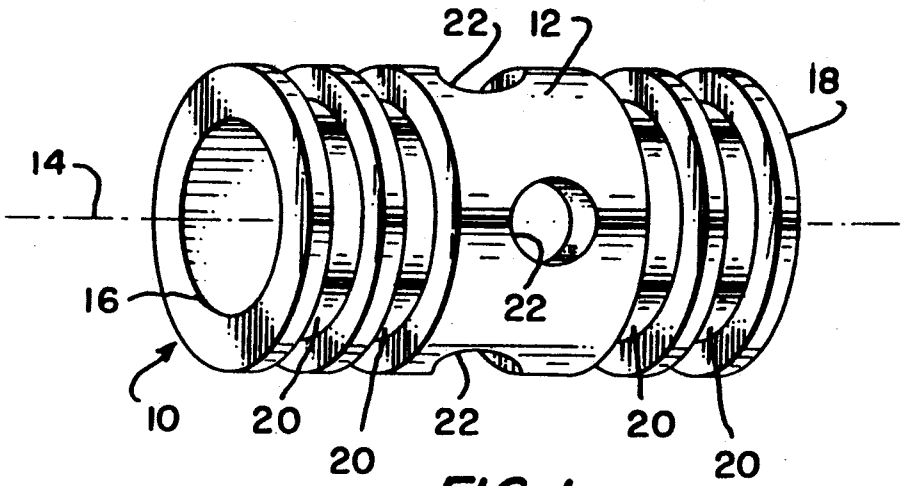
FIG. 1 is a perspective illustration of an embodiment of the invention.

As shown in FIG. 1, the novel sealing ring carrier and valve support 10 comprises a cylinder 12 which is devoid of internal structure. The cylinder comprises a body having a longitudinal axis 14 and parallel bearing surfaces 16 and 18 at opposite axcial ends of the body. Adjacent both axial ends of the cylinder 12 are grooves 20, the same being provided in which to seat sealing rings (not shown). Intermediate the axial ends of the cylinder 12, throughgoing apertures 22 are formed. In this embodiment 10, there are four of such apertures 22 (only one being shown, and profiles of two others being visible).

Figure 2:
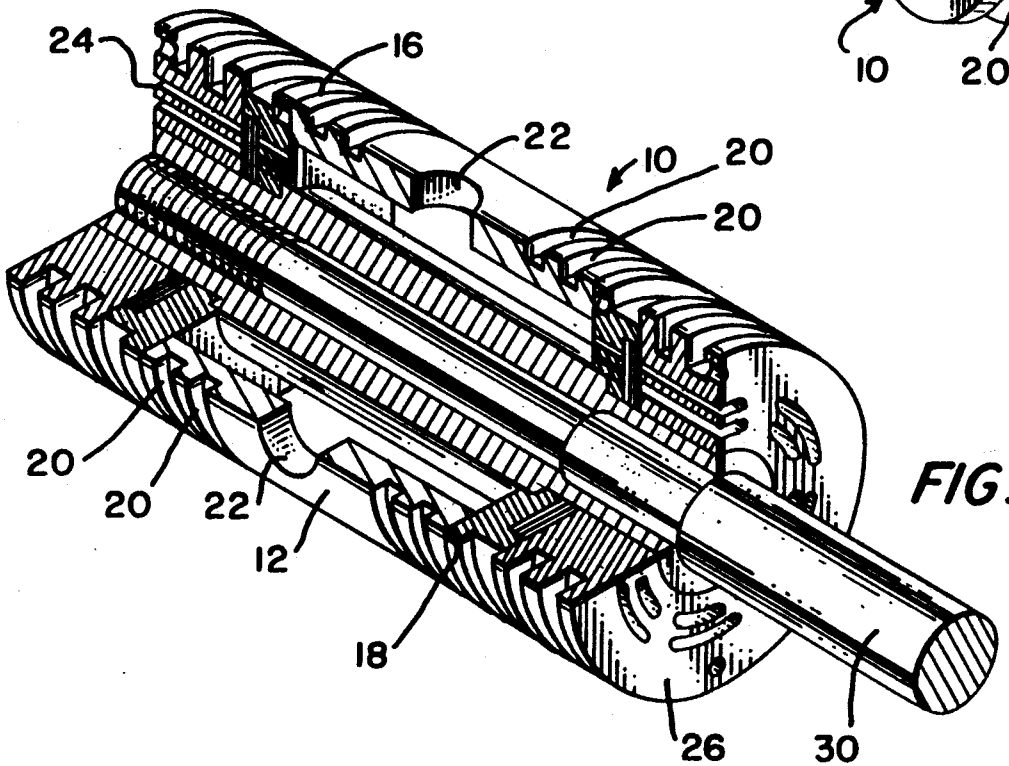
FIG. 2 is a perspective illustration, partly in cross-section, showing the embodiment of FIG. 1 in operative disposition between one-way valves carried, in spaced-apart disposition, centrally on a reciprocable piston rod.

In FIG. 2, the sealing ring carrier and valve support 10 is shown interposed between one-way fluid valves 24 and 26. The bearing surfaces 16 and 18 are in abutting engagement with the outermost peripheries of the axial ends of the valves. Consequently, the carrier and valve support 10 prevents the occurrence of the cited bending moment which, otherwise would be susceptible of occurring due to the center support of the valves 24 and 26 on the reciprocable rod 30. Here, now, the valves are supported at their internal diameters by the rod 30, and supported at their outside diameters by the carrier and valve support 10.

As explained in U.S. Pat. No. 5,015,158, the cylinder in which the rod-mounted, one-way valves 24 and 26 operate has a compressed fluid discharge port formed intermediate the ends thereof. The apertures 22 are provided to permit the compressed fluid to communicate with the discharge port.

The grooves 20 accommodate sealing rings, to supplement the sealing rings (not shown) which are carried by the valves 24 and 26. Consequently, such enhanced sealing will hold against a greater discharge or differential pressure.

While I have described the invention in connection with a specific embodiment thereof, it is to be clearly understood that this is done only by way of example, and not as a limitation to the scope of the invention, as set forth in the objects thereof and in the appended claims.

I claim:

1. A sealing ring carrier and valve support, comprising:

a body having (a) a longitudinal axis, and (b) parallel bearing surfaces at opposite axial ends of said body; wherein said body has means formed therein, adjacent both axial ends thereof, for receiving body-circumscribing sealing elements;

said body comprises a straight cylinder from end to end thereof;

said cylinder is devoid of internal structure; and said cylinder has at least one aperture formed therein, opening internally and externally of said cylinder, intermediate said axial ends thereof.

2. A sealing ring carrier and valve support, according to claim 1, wherein:

said sealing elements receiving means comprises grooves formed in the external surface of said cylinder.

3. In combination with fluid-control valves in spaced-apart disposition on a reciprocable rod, a sealing ring carrier and valve support, comprising:

a body having (a) longitudinal axis, and (b) parallel bearing surfaces at opposite axial ends thereof; wherein said body is interposed between said valves;

said bearing surfaces are in abutting engagement with said valves;

said body further has means formed therein, adjacent both axial ends thereof, for receiving body-circumscribing sealing elements;

said body comprises a straight cylinder from end to end; and said cylinder is devoid of internal structure.

4. The combination of claim 3, wherein:

said cylinder has at least one aperture formed therein, opening internally and externally of said cylinder, intermediate said axial ends thereof.

5. The combination of claim 3, wherein:

said cylinder has grooves formed in the external surface thereof, for receiving body-circumscribing sealing elements, adjacent both axial ends thereof.

6. In combination with fluid-control valves, centrally supported, in spaced-apart disposition on a reciprocable rod, a sealing ring carrier and valve support, comprising:

a body having a longitudinal axis, and parallel bearing surfaces at opposite axial ends thereof; wherein said body is interposed between said valves;

said bearing surfaces are in abutting engagement with outermost peripheries of axial ends of said valves;

said body comprises a straight cylinder from end to end thereof; and said cylinder is devoid of internal structure.

7. The combination of claim 6, wherein:

said body has means formed therein, adjacent both axial ends thereof, for receiving body-circumscribing sealing elements.

* * * * *